US009057242B2

(12) United States Patent
Mazyar et al.

(10) Patent No.: US 9,057,242 B2
(45) Date of Patent: Jun. 16, 2015

(54) METHOD OF CONTROLLING CORROSION RATE IN DOWNHOLE ARTICLE, AND DOWNHOLE ARTICLE HAVING CONTROLLED CORROSION RATE

(75) Inventors: Oleg A. Mazyar, Houston, TX (US); Michael Johnson, Katy, TX (US); Sean Gaudette, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 861 days.

(21) Appl. No.: 13/204,359

(22) Filed: Aug. 5, 2011

(65) Prior Publication Data

US 2013/0032357 A1 Feb. 7, 2013

(51) Int. Cl.

| | |
|---|---|
| ***E21B 29/00*** | (2006.01) |
| ***E21B 34/06*** | (2006.01) |
| ***E21B 34/14*** | (2006.01) |
| ***E21B 33/12*** | (2006.01) |
| ***E21B 41/00*** | (2006.01) |

(52) U.S. Cl.

CPC ..... *E21B 34/063* (2013.01); *E21B 34/14* (2013.01); *E21B 33/12* (2013.01); *E21B 29/00* (2013.01); *E21B 41/00* (2013.01)

(58) Field of Classification Search

CPC ..... E21B 10/00; E21B 44/00; E21B 33/12; E21B 43/26; E21B 17/028; E21B 23/00

USPC ..... 166/376

See application file for complete search history.

(56) References Cited

U.S. PATENT DOCUMENTS

| | | | |
|---|---|---|---|
| 1,468,905 | A | 9/1923 | Herman |
| 2,238,895 | A | 4/1941 | Gage |
| 2,261,292 | A | 11/1941 | Salnikov |
| 2,294,648 | A | 9/1942 | Ansel et al. |
| 2,301,624 | A | 11/1942 | Holt |
| 2,754,910 | A | 7/1956 | Derrick et al. |
| 2,983,634 | A | 5/1961 | Budininkas et al. |
| 3,057,405 | A | 10/1962 | Mallinger |
| 3,106,959 | A | 10/1963 | Huitt et al. |
| 3,152,009 | A | 10/1964 | DeLong |
| 3,196,949 | A | 7/1965 | Thomas |
| 3,242,988 | A | 3/1966 | McGuire et al. |

(Continued)

FOREIGN PATENT DOCUMENTS

| | | |
|---|---|---|
| CN | 1076968 | 10/1993 |
| CN | 1255879 A | 11/2000 |

(Continued)

OTHER PUBLICATIONS

Canadian Pat. App. No. 2783241 filed on Dec. 7, 2010 titled Nanomatrix Powder Metal Compact.

(Continued)

*Primary Examiner* — Jennifer H Gay
*Assistant Examiner* — Caroline Butcher
(74) *Attorney, Agent, or Firm* — Cantor Colburn LLP

(57) ABSTRACT

A method of removing a downhole assembly comprises contacting, in the presence of an electrolyte, a first article comprising a first material and acting as an anode, and a second article comprising a second material having a lower reactivity than the first material and acting as a cathode, the downhole assembly comprising the first article in electrical contact with the second article, wherein at least a portion of the first article is corroded in the electrolyte.

21 Claims, 4 Drawing Sheets

(56) References Cited

U.S. PATENT DOCUMENTS 3,316,748 A 5/1967 Lang et al.
3,347,317 A 10/1967 Zandemer
3,347,714 A 10/1967 Broverman et al.
3,390,724 A 7/1968 Caldwell
3,395,758 A 8/1968 Kelly et al.
3,406,101 A 10/1968 Kilpatrick
3,434,537 A 3/1969 Zandmer
3,465,181 A 9/1969 Colby et al.
3,513,230 A 5/1970 Rhees et al.
3,637,446 A 1/1972 Elliott et al.
3,645,331 A 2/1972 Maurer et al.
3,765,484 A 10/1973 Hamby, Jr. et al.
3,768,563 A 10/1973 Blount
3,775,823 A 12/1973 Adolph et al.
3,878,889 A 4/1975 Seabourn
3,894,850 A 7/1975 Kovalchuk et al.
3,924,677 A 12/1975 Prenner et al.
4,010,583 A 3/1977 Highberg
4,039,717 A 8/1977 Titus
4,050,529 A 9/1977 Tagirov et al.
4,248,307 A 2/1981 Silberman et al.
4,372,384 A 2/1983 Kinney
4,373,584 A 2/1983 Silberman et al.
4,373,952 A 2/1983 Parent
4,374,543 A 2/1983 Richardson
4,384,616 A 5/1983 Dellinger
4,395,440 A 7/1983 Abe et al.
4,399,871 A 8/1983 Adkins et al.
4,407,368 A 10/1983 Erbstoesser
4,422,508 A 12/1983 Rutledge, Jr. et al.
4,452,311 A 6/1984 Speegle et al.
4,475,729 A 10/1984 Costigan
4,498,543 A 2/1985 Pye et al.
4,499,048 A 2/1985 Hanejko
4,499,049 A 2/1985 Hanejko
4,526,840 A 7/1985 Jarabek
4,534,414 A 8/1985 Pringle
4,539,175 A 9/1985 Lichti et al.
4,554,986 A 11/1985 Jones
4,640,354 A 2/1987 Boisson
4,664,962 A 5/1987 DesMarais, Jr.
4,668,470 A 5/1987 Gilman et al.
4,673,549 A 6/1987 Ecer
4,674,572 A 6/1987 Gallus
4,678,037 A 7/1987 Smith
4,681,133 A 7/1987 Weston
4,688,641 A 8/1987 Knieriemen
4,693,863 A 9/1987 Del Corso et al.
4,703,807 A 11/1987 Weston
4,706,753 A 11/1987 Ohkochi et al.
4,708,202 A 11/1987 Sukup et al.
4,708,208 A 11/1987 Halbardier
4,709,761 A 12/1987 Setterberg, Jr.
4,714,116 A 12/1987 Brunner
4,721,159 A 1/1988 Ohkochi et al.
4,738,599 A 4/1988 Shilling
4,768,588 A 9/1988 Kupsa
4,775,598 A 10/1988 Jaeckel
4,784,226 A 11/1988 Wyatt
4,805,699 A 2/1989 Halbardier
4,817,725 A 4/1989 Jenkins
4,834,184 A 5/1989 Streich et al.
H635 H 6/1989 Johnson et al.
4,850,432 A 7/1989 Porter et al.
4,853,056 A 8/1989 Hoffman
4,869,324 A 9/1989 Holder
4,869,325 A 9/1989 Halbardier
4,889,187 A 12/1989 Terrell et al.
4,890,675 A 1/1990 Dew
4,909,320 A 3/1990 Hebert et al.
4,929,415 A 5/1990 Okazaki
4,932,474 A 6/1990 Schroeder, Jr. et al.
4,938,309 A 7/1990 Emdy
4,938,809 A 7/1990 Das et al.
4,944,351 A 7/1990 Eriksen et al.
4,949,788 A 8/1990 Szarka et al.
4,952,902 A 8/1990 Kawaguchi et al.
4,975,412 A 12/1990 Okazaki et al.
4,977,958 A 12/1990 Miller
4,981,177 A 1/1991 Carmody et al.
4,986,361 A 1/1991 Mueller et al.
4,997,622 A 3/1991 Regazzoni et al.
5,006,044 A 4/1991 Walker, Sr. et al.
5,010,955 A 4/1991 Springer
5,036,921 A 8/1991 Pittard et al.
5,048,611 A 9/1991 Cochran
5,049,165 A 9/1991 Tselesin
5,061,323 A 10/1991 DeLuccia
5,063,775 A 11/1991 Walker, Sr. et al.
5,073,207 A 12/1991 Faure et al.
5,074,361 A 12/1991 Brisco et al.
5,076,869 A 12/1991 Bourell et al.
5,084,088 A 1/1992 Okazaki
5,087,304 A 2/1992 Chang et al.
5,090,480 A 2/1992 Pittard et al.
5,095,988 A 3/1992 Bode
5,103,911 A 4/1992 Heijnen
5,117,915 A 6/1992 Mueller et al.
5,161,614 A 11/1992 Wu et al.
5,178,216 A 1/1993 Giroux et al.
5,181,571 A 1/1993 Mueller et al.
5,183,631 A 2/1993 Kugimiya et al.
5,188,182 A 2/1993 Echols, III et al.
5,188,183 A 2/1993 Hopmann et al.
5,204,055 A 4/1993 Sachs et al.
5,222,867 A 6/1993 Walker, Sr. et al.
5,226,483 A 7/1993 Williamson, Jr.
5,228,518 A 7/1993 Wilson et al.
5,234,055 A 8/1993 Cornette
5,253,714 A 10/1993 Davis et al.
5,271,468 A 12/1993 Streich et al.
5,282,509 A 2/1994 Schurr, III
5,293,940 A 3/1994 Hromas et al.
5,304,260 A 4/1994 Aikawa et al.
5,309,874 A 5/1994 Willermet et al.
5,310,000 A 5/1994 Arterbury et al.
5,316,598 A 5/1994 Chang et al.
5,318,746 A 6/1994 Lashmore
5,380,473 A 1/1995 Bogue et al.
5,387,380 A 2/1995 Cima et al.
5,392,860 A 2/1995 Ross
5,394,941 A 3/1995 Venditto et al.
5,398,754 A 3/1995 Dinhoble
5,407,011 A 4/1995 Layton
5,409,555 A 4/1995 Fujita et al.
5,411,082 A 5/1995 Kennedy
5,417,285 A 5/1995 Van Buskirk et al.
5,427,177 A 6/1995 Jordan, Jr. et al.
5,435,392 A 7/1995 Kennedy
5,439,051 A 8/1995 Kennedy et al.
5,454,430 A 10/1995 Kennedy et al.
5,456,317 A 10/1995 Hood, III et al.
5,464,062 A 11/1995 Blizzard, Jr.
5,472,048 A 12/1995 Kennedy et al.
5,474,131 A 12/1995 Jordan, Jr. et al.
5,477,923 A 12/1995 Jordan, Jr. et al.
5,507,439 A 4/1996 Story
5,526,880 A 6/1996 Jordan, Jr. et al.
5,526,881 A 6/1996 Martin et al.
5,529,746 A 6/1996 Knoss et al.
5,533,573 A 7/1996 Jordan, Jr. et al.
5,536,485 A 7/1996 Kume et al.
5,558,153 A 9/1996 Holcombe et al.
5,607,017 A 3/1997 Owens et al.
5,623,993 A 4/1997 Van Buskirk et al.
5,623,994 A 4/1997 Robinson
5,636,691 A 6/1997 Hendrickson et al.
5,641,023 A 6/1997 Ross et al.
5,647,444 A 7/1997 Williams
5,665,289 A 9/1997 Chung et al.
5,677,372 A 10/1997 Yamamoto et al.
5,685,372 A 11/1997 Gano
5,701,576 A 12/1997 Fujita et al.
5,707,214 A 1/1998 Schmidt

(56) References Cited

U.S. PATENT DOCUMENTS 5,709,269 A 1/1998 Head
5,720,344 A 2/1998 Newman
5,728,195 A 3/1998 Eastman et al.
5,765,639 A 6/1998 Muth
5,772,735 A 6/1998 Sehgal et al.
5,782,305 A 7/1998 Hicks
5,797,454 A 8/1998 Hipp
5,826,652 A 10/1998 Tapp
5,826,661 A 10/1998 Parker et al.
5,829,520 A 11/1998 Johnson
5,836,396 A 11/1998 Norman
5,857,521 A 1/1999 Ross et al.
5,881,816 A 3/1999 Wright
5,896,819 A 4/1999 Turila et al.
5,902,424 A 5/1999 Fujita et al.
5,934,372 A 8/1999 Muth
5,960,881 A 10/1999 Allamon et al.
5,990,051 A 11/1999 Ischy et al.
5,992,452 A 11/1999 Nelson, II
5,992,520 A 11/1999 Schultz et al.
6,007,314 A 12/1999 Nelson, II
6,024,915 A 2/2000 Kume et al.
6,032,735 A 3/2000 Echols
6,036,777 A 3/2000 Sachs
6,047,773 A 4/2000 Zeltmann et al.
6,050,340 A 4/2000 Scott
6,069,313 A 5/2000 Kay
6,076,600 A 6/2000 Vick, Jr. et al.
6,079,496 A 6/2000 Hirth
6,085,837 A 7/2000 Massinon et al.
6,095,247 A 8/2000 Streich et al.
6,119,783 A 9/2000 Parker et al.
6,142,237 A 11/2000 Christmas et al.
6,161,622 A 12/2000 Robb et al.
6,167,970 B1 1/2001 Stout et al.
6,170,583 B1 1/2001 Boyce
6,173,779 B1 1/2001 Smith
6,189,616 B1 2/2001 Gano et al.
6,213,202 B1 4/2001 Read, Jr.
6,220,350 B1 4/2001 Brothers et al.
6,220,357 B1 4/2001 Carmichael
6,228,904 B1 5/2001 Yadav et al.
6,237,688 B1 5/2001 Burleson et al.
6,238,280 B1 5/2001 Ritt et al.
6,241,021 B1 6/2001 Bowling
6,248,399 B1 6/2001 Hehmann
6,250,392 B1 6/2001 Muth
6,273,187 B1 8/2001 Voisin, Jr. et al.
6,276,452 B1 8/2001 Davis et al.
6,276,457 B1 8/2001 Moffatt et al.
6,279,656 B1 8/2001 Sinclair et al.
6,287,445 B1 9/2001 Lashmore et al.
6,302,205 B1 10/2001 Ryll
6,315,041 B1 11/2001 Carlisle et al.
6,315,050 B2 11/2001 Vaynshteyn et al.
6,325,148 B1 12/2001 Trahan et al.
6,328,110 B1 12/2001 Joubert
6,341,653 B1 1/2002 Firmaniuk et al.
6,349,766 B1 2/2002 Bussear et al.
6,354,379 B2 3/2002 Miszewski et al.
6,357,332 B1 3/2002 Vecchio
6,371,206 B1 4/2002 Mills
6,372,346 B1 4/2002 Toth
6,382,244 B2 5/2002 Vann
6,390,195 B1 5/2002 Nguyen et al.
6,390,200 B1 5/2002 Allamon et al.
6,394,185 B1 5/2002 Constien
6,397,950 B1 6/2002 Streich et al.
6,408,946 B1 6/2002 Marshall et al.
6,419,023 B1 7/2002 George et al.
6,439,313 B1 8/2002 Thomeer et al.
6,457,525 B1 10/2002 Scott
6,467,546 B2 10/2002 Allamon et al.
6,470,965 B1 10/2002 Winzer
6,491,097 B1 12/2002 ONeal et al.
6,491,116 B2 12/2002 Berscheidt et al.
6,513,598 B2 2/2003 Moore et al.
6,540,033 B1 4/2003 Sullivan et al.
6,543,543 B2 4/2003 Muth
6,561,275 B2 5/2003 Glass et al.
6,588,507 B2 7/2003 Dusterhoft et al.
6,591,915 B2 7/2003 Burris et al.
6,601,648 B2 8/2003 Ebinger
6,601,650 B2 8/2003 Sundararajan
6,609,569 B2 8/2003 Howlett et al.
6,612,826 B1 9/2003 Bauer et al.
6,613,383 B1 9/2003 George et al.
6,619,400 B2 9/2003 Brunet
6,634,428 B2 10/2003 Krauss et al.
6,662,886 B2 12/2003 Russell
6,675,889 B1 1/2004 Mullins et al.
6,699,305 B2 3/2004 Myrick
6,713,177 B2 3/2004 George et al.
6,715,541 B2 4/2004 Pedersen et al.
6,719,051 B2 4/2004 Hailey, Jr. et al.
6,755,249 B2 6/2004 Robison et al.
6,776,228 B2 8/2004 Pedersen et al.
6,779,599 B2 8/2004 Mullins et al.
6,799,638 B2 10/2004 Butterfield, Jr.
6,810,960 B2 11/2004 Pia
6,817,414 B2 11/2004 Lee
6,831,044 B2 12/2004 Constien
6,883,611 B2 4/2005 Smith et al.
6,887,297 B2 5/2005 Winter et al.
6,896,049 B2 5/2005 Moyes
6,896,061 B2 5/2005 Hriscu et al.
6,899,176 B2 5/2005 Hailey, Jr. et al.
6,899,777 B2 5/2005 Vaidyanathan et al.
6,908,516 B2 6/2005 Hehmann et al.
6,913,827 B2 7/2005 George et al.
6,926,086 B2 8/2005 Patterson et al.
6,932,159 B2 8/2005 Hovem
6,945,331 B2 9/2005 Patel
6,951,331 B2 10/2005 Haughom et al.
6,959,759 B2 11/2005 Doane et al.
6,973,970 B2 12/2005 Johnston et al.
6,973,973 B2 12/2005 Howard et al.
6,983,796 B2 1/2006 Bayne et al.
6,986,390 B2 1/2006 Doane et al.
7,013,989 B2 3/2006 Hammond et al.
7,017,664 B2 3/2006 Walker et al.
7,017,677 B2 3/2006 Keshavan et al.
7,021,389 B2 4/2006 Bishop et al.
7,025,146 B2 4/2006 King et al.
7,028,778 B2 4/2006 Krywitsky
7,044,230 B2 5/2006 Starr et al.
7,049,272 B2 5/2006 Sinclair et al.
7,051,805 B2 5/2006 Doane et al.
7,059,410 B2 6/2006 Bousche et al.
7,090,027 B1 8/2006 Williams
7,093,664 B2 8/2006 Todd et al.
7,096,945 B2 8/2006 Richards et al.
7,096,946 B2 8/2006 Jasser et al.
7,097,906 B2 8/2006 Gardner
7,108,080 B2 9/2006 Tessari et al.
7,111,682 B2 9/2006 Blaisdell
7,141,207 B2 11/2006 Jandeska, Jr. et al.
7,150,326 B2 12/2006 Bishop et al.
7,163,066 B2 1/2007 Lehr
7,174,963 B2 2/2007 Bertelsen
7,182,135 B2 2/2007 Szarka
7,188,559 B1 3/2007 Vecchio
7,210,527 B2 5/2007 Walker et al.
7,210,533 B2 5/2007 Starr et al.
7,217,311 B2 5/2007 Hong et al.
7,234,530 B2 6/2007 Gass
7,252,162 B2 8/2007 Akinlade et al.
7,255,172 B2 8/2007 Johnson
7,255,178 B2 8/2007 Slup et al.
7,264,060 B2 9/2007 Wills
7,267,172 B2 9/2007 Hofman
7,267,178 B2 9/2007 Krywitsky
7,270,186 B2 9/2007 Johnson
7,287,592 B2 10/2007 Surjaatmadja et al.

(56) References Cited

U.S. PATENT DOCUMENTS 7,311,152 B2 12/2007 Howard et al.
7,316,274 B2 1/2008 Xu et al.
7,320,365 B2 1/2008 Pia
7,322,412 B2 1/2008 Badalamenti et al.
7,322,417 B2 1/2008 Rytlewski et al.
7,325,617 B2 2/2008 Murray
7,328,750 B2 2/2008 Swor et al.
7,331,388 B2 2/2008 Vilela et al.
7,337,854 B2 3/2008 Horn et al.
7,346,456 B2 3/2008 Le Bemadjiel
7,360,593 B2 4/2008 Constien
7,360,597 B2 4/2008 Blaisdell
7,384,443 B2 6/2008 Mirchandani
7,387,158 B2 6/2008 Murray et al.
7,387,165 B2 6/2008 Lopez de Cardenas et al.
7,392,841 B2 7/2008 Murray et al.
7,401,648 B2 7/2008 Richard
7,416,029 B2 8/2008 Telfer et al.
7,422,058 B2 9/2008 O'Malley
7,426,964 B2 9/2008 Lynde et al.
7,441,596 B2 10/2008 Wood et al.
2,080,277 A1 11/2008 Koda et al.
7,445,049 B2 11/2008 Howard et al.
7,451,815 B2 11/2008 Hailey, Jr.
7,451,817 B2 11/2008 Reddy et al.
7,461,699 B2 12/2008 Richard et al.
7,464,764 B2 12/2008 Xu
7,472,750 B2 1/2009 Walker et al.
7,478,676 B2 1/2009 East, Jr. et al.
7,503,390 B2 3/2009 Gomez
7,503,399 B2 3/2009 Badalamenti et al.
7,510,018 B2 3/2009 Williamson et al.
7,513,311 B2 4/2009 Gramstad et al.
7,527,103 B2 5/2009 Huang et al.
7,537,825 B1 5/2009 Wardle et al.
7,552,777 B2 6/2009 Murray et al.
7,552,779 B2 6/2009 Murray
7,575,062 B2 8/2009 East, Jr.
7,591,318 B2 9/2009 Tilghman
7,600,572 B2 10/2009 Slup et al.
7,604,055 B2 10/2009 Richard et al.
7,617,871 B2 11/2009 Surjaatmadja et al.
7,635,023 B2 12/2009 Goldberg et al.
7,640,988 B2 1/2010 Phi et al.
7,661,480 B2 2/2010 Al-Anazi
7,661,481 B2 2/2010 Todd et al.
7,665,537 B2 2/2010 Patel et al.
7,686,082 B2 3/2010 Marsh
7,690,436 B2 4/2010 Turley et al.
7,699,101 B2 * 4/2010 Fripp et al. ..... 166/229
7,703,510 B2 4/2010 Xu
7,703,511 B2 4/2010 Buyers et al.
7,708,078 B2 5/2010 Stoesz
7,709,421 B2 5/2010 Jones et al.
7,712,541 B2 5/2010 Loretz et al.
7,723,272 B2 5/2010 Crews et al.
7,726,406 B2 6/2010 Xu
7,735,578 B2 6/2010 Loehr et al.
7,752,971 B2 7/2010 Loehr
7,757,773 B2 7/2010 Rytlewski
7,762,342 B2 7/2010 Richard et al.
7,770,652 B2 8/2010 Barnett
7,775,284 B2 8/2010 Richards et al.
7,775,285 B2 8/2010 Surjaatmadja et al.
7,775,286 B2 8/2010 Duphorne
7,784,543 B2 8/2010 Johnson
7,793,714 B2 9/2010 Johnson
7,798,225 B2 9/2010 Giroux et al.
7,798,226 B2 9/2010 Themig
7,798,236 B2 9/2010 McKeachnie et al.
7,806,189 B2 10/2010 Frazier
7,806,192 B2 10/2010 Foster et al.
7,810,553 B2 10/2010 Cruickshank et al.
7,810,567 B2 10/2010 Daniels et al.
7,819,198 B2 10/2010 Birckhead et al.
7,828,055 B2 11/2010 Willauer et al.
7,833,944 B2 11/2010 Munoz et al.
7,849,927 B2 12/2010 Herrera
7,855,168 B2 12/2010 Fuller et al.
7,861,779 B2 1/2011 Vestavik
7,861,781 B2 1/2011 D'Arcy
7,874,365 B2 1/2011 East, Jr. et al.
7,878,253 B2 2/2011 Stowe et al.
7,896,091 B2 3/2011 Williamson et al.
7,897,063 B1 3/2011 Perry et al.
7,900,696 B1 3/2011 Nish et al.
7,900,703 B2 3/2011 Clark et al.
7,909,096 B2 3/2011 Clark et al.
7,909,104 B2 3/2011 Bjorgum
7,909,110 B2 3/2011 Sharma et al.
7,909,115 B2 3/2011 Grove et al.
7,913,765 B2 3/2011 Crow et al.
7,931,093 B2 4/2011 Foster et al.
7,938,191 B2 5/2011 Vaidya
7,946,335 B2 5/2011 Bewlay et al.
7,946,340 B2 5/2011 Surjaatmadja et al.
7,958,940 B2 6/2011 Jameson
7,963,331 B2 6/2011 Surjaatmadja et al.
7,963,340 B2 6/2011 Gramstad et al.
7,963,342 B2 6/2011 George
7,980,300 B2 7/2011 Roberts et al.
7,987,906 B1 8/2011 Troy
7,992,763 B2 8/2011 Vecchio et al.
8,020,619 B1 9/2011 Robertson et al.
8,020,620 B2 9/2011 Daniels et al.
8,025,104 B2 9/2011 Cooke, Jr.
8,028,767 B2 10/2011 Radford et al.
8,033,331 B2 10/2011 Themig
8,039,422 B1 10/2011 Al-Zahrani
8,056,628 B2 11/2011 Whitsitt et al.
8,056,638 B2 11/2011 Clayton et al.
8,109,340 B2 2/2012 Doane et al.
8,127,856 B1 3/2012 Nish et al.
8,153,052 B2 4/2012 Jackson et al.
8,163,060 B2 4/2012 Imanishi et al.
8,211,247 B2 7/2012 Marya et al.
8,211,248 B2 7/2012 Marya
8,226,740 B2 7/2012 Chaumonnot et al.
8,230,731 B2 7/2012 Dyer et al.
8,231,947 B2 7/2012 Vaidya et al.
8,276,670 B2 10/2012 Patel
8,277,974 B2 10/2012 Kumar et al.
8,297,364 B2 10/2012 Agrawal et al.
8,327,931 B2 12/2012 Agrawal et al.
8,403,037 B2 3/2013 Agrawal et al.
8,425,651 B2 4/2013 Xu et al.
2001/0045285 A1 11/2001 Russell
2001/0045288 A1 11/2001 Allamon et al.
2002/0000319 A1 1/2002 Brunet
2002/0007948 A1 1/2002 Bayne et al.
2002/0014268 A1 2/2002 Vann
2002/0066572 A1 6/2002 Muth
2002/0104616 A1 8/2002 De et al.
2002/0136904 A1 9/2002 Glass et al.
2002/0162661 A1 11/2002 Krauss et al.
2003/0037925 A1 2/2003 Walker et al.
2003/0060374 A1 3/2003 Cooke, Jr.
2003/0075326 A1 4/2003 Ebinger
2003/0104147 A1 6/2003 Bretschneider et al.
2003/0111728 A1 6/2003 Thai et al.
2003/0127013 A1 7/2003 Zavitsanos et al.
2003/0141060 A1 7/2003 Hailey et al.
2003/0141061 A1 7/2003 Hailey et al.
2003/0141079 A1 7/2003 Doane et al.
2003/0150614 A1 8/2003 Brown et al.
2003/0155114 A1 8/2003 Pedersen et al.
2003/0155115 A1 8/2003 Pedersen et al.
2003/0159828 A1 8/2003 Howard et al.
2003/0164237 A1 9/2003 Butterfield
2003/0183391 A1 10/2003 Hriscu et al.
2004/0005483 A1 1/2004 Lin
2004/0020832 A1 2/2004 Richards et al.
2004/0031605 A1 2/2004 Mickey
2004/0045723 A1 3/2004 Slup et al.

(56) References Cited

U.S. PATENT DOCUMENTS

2004/0055758 A1 3/2004 Brezinski et al.
2004/0089449 A1 5/2004 Walton et al.
2004/0154806 A1 8/2004 Bode et al.
2004/0159428 A1 8/2004 Hammond et al.
2004/0182583 A1 9/2004 Doane et al.
2004/0256109 A1 12/2004 Johnson
2004/0256157 A1 12/2004 Tessari et al.
2004/0261993 A1 12/2004 Nguyen
2005/0034876 A1 2/2005 Doane et al.
2005/0051329 A1 3/2005 Blaisdell
2005/0064247 A1 3/2005 Sane et al.
2005/0069449 A1 3/2005 Jackson et al.
2005/0102255 A1 5/2005 Bultman
2005/0106316 A1 5/2005 Rigney et al.
2005/0126334 A1 6/2005 Mirchandani
2005/0161224 A1 7/2005 Starr et al.
2005/0165149 A1 7/2005 Chanak et al.
2005/0194143 A1 9/2005 Xu et al.
2005/0199401 A1 9/2005 Patel et al.
2005/0205264 A1 9/2005 Starr et al.
2005/0205266 A1 9/2005 Todd et al.
2005/0241824 A1 11/2005 Burris, II et al.
2005/0241825 A1 11/2005 Burris, II et al.
2005/0257936 A1 11/2005 Lehr
2005/0279501 A1 12/2005 Surjaatmadja et al.
2006/0012087 A1 1/2006 Matsuda et al.
2006/0045787 A1 3/2006 Jandeska, Jr. et al.
2006/0057479 A1 3/2006 Niimi et al.
2006/0081378 A1 4/2006 Howard et al.
2006/0102871 A1 5/2006 Wang et al.
2006/0108114 A1 5/2006 Johnson et al.
2006/0108126 A1 5/2006 Horn et al.
2006/0116696 A1 6/2006 Odermatt et al.
2006/0124310 A1 6/2006 Lopez de Cardenas
2006/0124312 A1 6/2006 Rytlewski et al.
2006/0131011 A1 6/2006 Lynde et al.
2006/0131081 A1 6/2006 Mirchandani et al.
2006/0144515 A1 7/2006 Tada et al.
2006/0150770 A1 7/2006 Freim, III et al.
2006/0151178 A1 7/2006 Howard et al.
2006/0162927 A1 7/2006 Walker et al.
2006/0169453 A1 8/2006 Savery et al.
2006/0207763 A1 9/2006 Hofman et al.
2006/0213670 A1 9/2006 Bishop et al.
2006/0231253 A1 10/2006 Vilela et al.
2006/0283592 A1 12/2006 Sierra et al.
2007/0017674 A1 1/2007 Blaisdell
2007/0017675 A1 1/2007 Hammami et al.
2007/0029082 A1 2/2007 Giroux et al.
2007/0039741 A1 2/2007 Hailey
2007/0044966 A1 3/2007 Davies et al.
2007/0051521 A1 3/2007 Fike et al.
2007/0053785 A1 3/2007 Hetz et al.
2007/0054101 A1 3/2007 Sigalas et al.
2007/0057415 A1 3/2007 Katagiri et al.
2007/0062644 A1 3/2007 Nakamura et al.
2007/0074601 A1 4/2007 Hong et al.
2007/0074873 A1 4/2007 McKeachnie et al.
2007/0102199 A1 5/2007 Smith et al.
2007/0107899 A1 5/2007 Werner et al.
2007/0107908 A1 5/2007 Vaidya et al.
2007/0108060 A1 5/2007 Park
2007/0119600 A1 5/2007 Slup et al.
2007/0131912 A1 6/2007 Simone et al.
2007/0151009 A1 7/2007 Conrad, III et al.
2007/0151769 A1 7/2007 Slutz et al.
2007/0169935 A1 7/2007 Akbar et al.
2007/0181224 A1* 8/2007 Marya et al. ..... 148/400
2007/0185655 A1 8/2007 Le Bemadjiel
2007/0187095 A1 8/2007 Walker et al.
2007/0221373 A1 9/2007 Murray
2007/0221384 A1 9/2007 Murray
2007/0261862 A1 11/2007 Murray
2007/0272411 A1 11/2007 Lopez De Cardenas et al.
2007/0272413 A1 11/2007 Rytlewski et al.
2007/0277979 A1 12/2007 Todd et al.
2007/0284109 A1 12/2007 East et al.
2007/0284112 A1 12/2007 Magne et al.
2007/0299510 A1 12/2007 Venkatraman et al.
2008/0011473 A1 1/2008 Wood et al.
2008/0020923 A1 1/2008 Debe et al.
2008/0047707 A1 2/2008 Boney et al.
2008/0060810 A9 3/2008 Nguyen et al.
2008/0066923 A1 3/2008 Xu
2008/0066924 A1 3/2008 Xu
2008/0072705 A1 3/2008 Chaumonnot et al.
2008/0078553 A1 4/2008 George
2008/0099209 A1 5/2008 Loretz et al.
2008/0115932 A1 5/2008 Cooke
2008/0121390 A1 5/2008 O'Malley et al.
2008/0135249 A1 6/2008 Fripp et al.
2008/0149325 A1 6/2008 Crawford
2008/0149345 A1 6/2008 Marya et al.
2008/0169105 A1 7/2008 Williamson et al.
2008/0179060 A1 7/2008 Surjaatmadja et al.
2008/0179104 A1 7/2008 Zhang et al.
2008/0202764 A1 8/2008 Clayton et al.
2008/0202814 A1 8/2008 Lyons et al.
2008/0210473 A1 9/2008 Zhang et al.
2008/0216383 A1 9/2008 Pierick et al.
2008/0223586 A1 9/2008 Barnett
2008/0223587 A1 9/2008 Cherewyk
2008/0236829 A1 10/2008 Lynde
2008/0248205 A1 10/2008 Blanchet et al.
2008/0277109 A1 11/2008 Vaidya
2008/0277980 A1 11/2008 Koda et al.
2008/0282924 A1 11/2008 Saenger et al.
2008/0296024 A1 12/2008 Huang et al.
2008/0314581 A1 12/2008 Brown
2008/0314588 A1 12/2008 Langlais et al.
2009/0044946 A1 2/2009 Schasteen et al.
2009/0044949 A1 2/2009 King et al.
2009/0050334 A1* 2/2009 Marya et al. ..... 166/376
2009/0056934 A1 3/2009 Xu
2009/0065216 A1 3/2009 Frazier
2009/0084553 A1 4/2009 Rytlewski et al.
2009/0084556 A1 4/2009 Richards et al.
2009/0090440 A1 4/2009 Kellett et al.
2009/0107684 A1 4/2009 Cooke
2009/0114381 A1 5/2009 Stroobants
2009/0114382 A1 5/2009 Grove et al.
2009/0145666 A1 6/2009 Radford et al.
2009/0151949 A1 6/2009 Marya et al.
2009/0155616 A1 6/2009 Thamida et al.
2009/0159289 A1 6/2009 Avant et al.
2009/0178808 A1 7/2009 Williamson et al.
2009/0194273 A1 8/2009 Surjaatmadja et al.
2009/0205841 A1 8/2009 Kluge et al.
2009/0226704 A1 9/2009 Kauppinen et al.
2009/0242202 A1 10/2009 Rispler et al.
2009/0242208 A1 10/2009 Bolding
2009/0242214 A1 10/2009 Foster et al.
2009/0255667 A1 10/2009 Clem et al.
2009/0255684 A1 10/2009 Bolding
2009/0255686 A1 10/2009 Richard et al.
2009/0260817 A1 10/2009 Gambier et al.
2009/0266548 A1 10/2009 Olsen et al.
2009/0272544 A1 11/2009 Giroux et al.
2009/0283270 A1 11/2009 Langeslag
2009/0293672 A1 12/2009 Mirchandani et al.
2009/0301730 A1 12/2009 Gweily
2009/0305131 A1 12/2009 Kumar et al.
2009/0308588 A1 12/2009 Howell et al.
2009/0317556 A1 12/2009 Macary
2010/0003536 A1 1/2010 Smith et al.
2010/0012385 A1 1/2010 Drivdahl et al.
2010/0015469 A1 1/2010 Romanowski et al.
2010/0025255 A1 2/2010 Su et al.
2010/0032151 A1 2/2010 Duphorne
2010/0040180 A1 2/2010 Kim et al.
2010/0044041 A1 2/2010 Smith et al.
2010/0051278 A1 3/2010 Mytopher et al.
2010/0055491 A1 3/2010 Vecchio et al.
2010/0055492 A1 3/2010 Barsoum et al.

(56) References Cited

U.S. PATENT DOCUMENTS

| | | | | |
|---|---|---|---|---|
| 2010/0089583 | A1 | 4/2010 | Xu et al. | |
| 2010/0089587 | A1 | 4/2010 | Stout | |
| 2010/0101803 | A1 | 4/2010 | Clayton et al. | |
| 2010/0122817 | A1 | 5/2010 | Surjaatmadja et al. | |
| 2010/0139930 | A1 | 6/2010 | Patel et al. | |
| 2010/0200230 | A1 | 8/2010 | East, Jr. et al. | |
| 2010/0236793 | A1 | 9/2010 | Bjorgum | |
| 2010/0236794 | A1 | 9/2010 | Duan et al. | |
| 2010/0243254 | A1 | 9/2010 | Murphy et al. | |
| 2010/0252273 | A1 | 10/2010 | Duphorne | |
| 2010/0252280 | A1 | 10/2010 | Swor et al. | |
| 2010/0270031 | A1 | 10/2010 | Patel | |
| 2010/0276136 | A1 | 11/2010 | Evans et al. | |
| 2010/0282338 | A1 | 11/2010 | Gerrard et al. | |
| 2010/0282469 | A1 | 11/2010 | Richard et al. | |
| 2010/0294510 | A1 | 11/2010 | Holmes | |
| 2010/0319870 | A1 | 12/2010 | Bewlay et al. | |
| 2011/0005773 | A1 | 1/2011 | Dusterhoft et al. | |
| 2011/0036592 | A1 | 2/2011 | Fay | |
| 2011/0048743 | A1 | 3/2011 | Stafford et al. | |
| 2011/0056692 | A1 | 3/2011 | Lopez De Cardenas et al. | |
| 2011/0056702 | A1 | 3/2011 | Sharma et al. | |
| 2011/0067872 | A1 | 3/2011 | Agrawal | |
| 2011/0067889 | A1 | 3/2011 | Marya et al. | |
| 2011/0067890 | A1 | 3/2011 | Themig | |
| 2011/0094406 | A1 | 4/2011 | Marya et al. | |
| 2011/0100643 | A1 | 5/2011 | Themig et al. | |
| 2011/0127044 | A1 | 6/2011 | Radford et al. | |
| 2011/0132621 | A1* | 6/2011 | Agrawal et al. | 166/376 |
| 2011/0139465 | A1 | 6/2011 | Tibbles et al. | |
| 2011/0147014 | A1 | 6/2011 | Chen et al. | |
| 2011/0186306 | A1 | 8/2011 | Marya et al. | |
| 2011/0214881 | A1 | 9/2011 | Newton et al. | |
| 2011/0247833 | A1 | 10/2011 | Todd et al. | |
| 2011/0253387 | A1 | 10/2011 | Ervin | |
| 2011/0256356 | A1 | 10/2011 | Tomantschger et al. | |
| 2011/0259610 | A1 | 10/2011 | Shkurti et al. | |
| 2011/0277987 | A1 | 11/2011 | Frazier | |
| 2011/0277989 | A1 | 11/2011 | Frazier | |
| 2011/0284232 | A1 | 11/2011 | Huang | |
| 2011/0284240 | A1 | 11/2011 | Chen et al. | |
| 2011/0284243 | A1 | 11/2011 | Frazier | |
| 2011/0300403 | A1 | 12/2011 | Vecchio et al. | |
| 2012/0067426 | A1 | 3/2012 | Soni et al. | |
| 2012/0103135 | A1 | 5/2012 | Xu et al. | |
| 2012/0107590 | A1 | 5/2012 | Xu et al. | |
| 2012/0118583 | A1 | 5/2012 | Johnson et al. | |
| 2012/0130470 | A1 | 5/2012 | Agnew et al. | |
| 2012/0145389 | A1 | 6/2012 | Fitzpatrick, Jr. | |
| 2012/0168152 | A1 | 7/2012 | Casciaro | |
| 2012/0211239 | A1 | 8/2012 | Kritzler et al. | |
| 2012/0267101 | A1 | 10/2012 | Cooke | |
| 2012/0292053 | A1 | 11/2012 | Xu et al. | |
| 2012/0318513 | A1* | 12/2012 | Mazyar et al. | 166/304 |
| 2013/0004847 | A1 | 1/2013 | Kumar et al. | |
| 2013/0025409 | A1 | 1/2013 | Xu | |
| 2013/0032357 | A1 | 2/2013 | Mazyar et al. | |
| 2013/0048304 | A1 | 2/2013 | Agrawal et al. | |
| 2013/0052472 | A1 | 2/2013 | Xu | |
| 2013/0081814 | A1 | 4/2013 | Gaudette et al. | |
| 2013/0105159 | A1 | 5/2013 | Alvarez et al. | |
| 2013/0126190 | A1 | 5/2013 | Mazyar et al. | |
| 2013/0133897 | A1 | 5/2013 | Baihly et al. | |
| 2013/0146144 | A1 | 6/2013 | Joseph et al. | |
| 2013/0146302 | A1 | 6/2013 | Gaudette et al. | |
| 2013/0186626 | A1 | 7/2013 | Aitken et al. | |
| 2013/0240203 | A1 | 9/2013 | Frazier | |
| 2013/0327540 | A1 | 12/2013 | Hamid et al. | |
| 2014/0116711 | A1 | 5/2014 | Tang et al. | |

FOREIGN PATENT DOCUMENTS

| | | | |
|---|---|---|---|
| CN | 101050417 | A | 10/2007 |
| CN | 101351523 | A | 1/2009 |
| CN | 101457321 | B | 6/2010 |
| EP | 0033625 | A1 | 8/1981 |
| EP | 1857570 | A2 | 11/2007 |
| GB | 912956 | | 12/1962 |
| JP | 61067770 | | 4/1986 |
| JP | 7-54008 | | 2/1995 |
| JP | 08232029 | | 9/1996 |
| JP | 08-232029 | A1 | 10/1996 |
| JP | 2010502840 | A | 1/2010 |
| KR | 95-0014350 | | 11/1995 |
| WO | 9947726 | A1 | 9/1999 |
| WO | 2008034042 | A3 | 3/2008 |
| WO | 2008079777 | A3 | 7/2008 |
| WO | WO2008079485 | | 7/2008 |
| WO | 2009079745 | A1 | 7/2009 |
| WO | 2011071902 | A3 | 6/2011 |
| WO | 2011071910 | A2 | 6/2011 |
| WO | 2011071910 | A3 | 6/2011 |
| WO | 2012174101 | A2 | 12/2012 |
| WO | 2013053057 | A1 | 4/2013 |
| WO | 2013078031 | A1 | 5/2013 |

OTHER PUBLICATIONS

Canadian Pat. App. No. 2783346 filed on Dec. 7, 2010, published on Jun. 16, 2011 for "Engineered Powder Compact Composite Material".

Flow Control Systems, [online]; [retrieved on May 20, 2010]; retrieved from the Internet http://www.bakerhughes.com/products-and-services/completions-and-productions/well-completions/packers-and-flow-control/flow-control-systems.

Optisleeve Sliding Sleeve, [online]; [retrieved on Jun. 25, 2010]; retrieved from the Internet weatherford.com/weatherford/groups/. . ./weatherfordcorp/WFT033159.pdf.

"Sliding Sleeve", Omega Completion Technology Ltd, Sep. 29, 2009, retrieved on: www.omega-completion.com.

Welch, William R. et al., "Nonelastomeric Sliding Sleeve Maintains Long Term Integrity in HP/HT Application: Case Histories" [Abstract Only], SPE Eastern Regional Meeting, Oct. 23-25, 1996, Columbus. Ohio.

Ambat, et al.; "Electroless Nickel-Plating on AZ91D Magnesium Alloy: Effect of Substrate Microstructure and Plating Parameters"; Surface and Coatings Technology; 179; pp. 124-134; (2004).

Chang, et al.; "Electrodeposition of Aluminum on Magnesium Alloy in Aluminum Chloride (A1C13)-1-ethy1-3-methylimidazolium chloride (EMIC) Ionic Liquid and Its Corrosion Behavior"; Electrochemistry Communications; 9; pp. 1602-1606; (2007).

Chun-Lin, Li. "Design of Abrasive Water Jet Perforation and Hydraulic Fracturing Tool," Oil Field Equipment, Mar. 2011.

Forsyth, et al.; "An Ionic Liquid Surface Treatment for Corrosion Protection of Magnesium Alloy AZ31"; Electrochem. Solid-State Lett./ 9(11); Abstract only; 1 page.

Forsyth, et al.; "Exploring Corrosion Protection of Mg Via Ionic Liquid Pretreatment"; Surface & Coatings Technology; 201; pp. 4496-4504; (2007).

Hsiao et al.; "Effect of Heat Treatment on Anodization and Electrochemical Behavior of AZ91D Magnesium Alloy"; J. Mater. Res.; 20(10); pp. 2763-2771;(2005).

Hsiao, et al.; "Anodization of AZ91D Magnesium Alloy in Silicate-Containing Electrolytes"; Surface & Coatings Technology; 199; pp. 127-134; (2005).

Hsiao, et al.; "Baking Treatment Effect on Materials Characteristics and Electrochemical Behavior of anodic Film Formed on AZ91D Magnesium Alloy"; Corrosion Science; 49; pp. 781-793; (2007).

Hsiao, et al.; "Characterization of Anodic Films Formed on AZ91D Magnesium Alloy"; Surface & Coatings Technology; 190; pp. 299-308; (2005).

Huo et al.; "Corrosion of AZ91D Magnesium Alloy with a Chemical Conversion Coating and Electroless Nickel Layer"; Corrosion Science: 46; pp. 1467-1477; (2004).

Notification of Transmittal of the International Search Report and the Written Opinion of the International Searching Authority; PCT/US2010/059257; Korean Intellectual Property Office; Mailed Jul. 27, 2011.

(56) References Cited

OTHER PUBLICATIONS

Liu, et al.; "Electroless Nickel Plating on AZ91 Mg Alloy Substrate"; Surface & Coatings Technology; 200; pp. 5087-5093; (2006).
Lunder et al.; "The Role of Mg17A112 Phase in the Corrosion of Mg Alloy AZ91"; Corrosion; 45(9); pp. 741-748; (1989).
Pardo, et al.; "Corrosion Behaviour of Magnesium/Aluminium Alloys in 3.5 wt% NaC1"; Corrosion Science; 50; pp. 823-834; (2008).
Shi et al.; "Influence of the Beta Phase on the Corrosion Performance of Anodised Coatings on Magnesium-Aluminium Alloys"; Corrosion Science; 47; pp. 2760-2777; (2005).
Song, et al.; "Corrosion Mechanisms of Magnesium Alloys"; Advanced Engineering Materials; 1(1); pp. 11-33; (1999).
Song, Guangling; "Recent Progress in Corrosion and Protection of Magnesium Alloys"; Advanced Engineering Materials; 7(7); pp. 563-586; (2005).
Song, et al.; "Influence of Microstructure on the Corrosion of Diecast AZ91D"; Corrosion Science; 41; pp. 249-273; (1999).
Song, et al.; "Corrosion Behaviour of AZ21, AZ501 and AZ91 in Sodium Chloride"; Corrosion Science; 40(10); pp. 1769-1791; (1998).
Song et al.; "Understanding Magnesium Corrosion"; Advanced Engineering Materials; 5; No. 12; pp. 837-858; (2003).
Zhang, et al.; "Study on the Environmentally Friendly Anodizing of AZ91D Magnesium Alloy"; Surface and Coatings Technology: 161; pp. 36-43; (2002).
International Search Report and Written Opinion; Mail Date Jul. 28, 2011; International Application No. PCT/US2010/057763; International Filing date Nov. 23, 2010; Korean Intellectual Property Office; International Search Report 7 pages; Written Opinion 3 pages.
H. Watarai, Trend of research and development for magnesium alloys-reducing the weight of structural materials in motor vehicles, (2006) Science and technology trends, Quaterly review No. 18, 84-97.
M. Bououdina, Z. X. Guo, Comparative study of mechanical alloying of (Mg+Al) and (Mg+Al+Ni) mixtures for hydrogen storage, J. Alloys, Compds, 2002, 336, 222-231.
M.Liu, P.J. Uggowitzer, A.V. Nagasekhar, P. Schmutz, M. Easton, G.L. Song, A. Atrens, Calculated phase diagrams and the corrosion of die-cast Mg-Al alloys, Corrosion Science, 2009, 51, 606-619.
S.L. Lee, C.W. Hsu, F.K. Hsu, C.Y. Chou, C.k. Lin, C.W. Weng, Effects of Ni addition on hydrogen storage properties of Mg17AL12alloy, Materials Chemistry and Physics, 2011, 126, 319-324.
T.J. Bastow, S. Celotto, Clustering and formation of nano-precipitates in dilute aluminum and magnesium alloys, Materials science and Engineering, 2003, C23, 757-762.
Constantine, Jesse. "Selective Production of Horizontal Openhole Completions Using ECP and Sliding Sleeve Technology." SPE Rocky Mountain Regional Meeting, May 15-18, 1999, Gillette, Wyoming. [Abstract Only].
Elsayed Ayman, Imai Hisashi, Umeda Junko and Kondoh Katsuyoshi, "Effect of Consolidation and Extrusion Temperatures on Tensile Properties of Hot Extruded ZK61 Magnesium Alloy Gas Atomized Powders via Spark Plasma Sintering" Transacation of JWRI, vol. 38, (2009) No. 2, pp. 31-35.
Bing Q. Han, Enrique J. Lavernia and Farghalli A. Mohamed, "Mechanical Properties of Nanostructured Materials", Rev. Adv. Mater. Sci. 9(2005) 1-16.
International Search Report and Written Opinion for PCT Application No. PCT/US2012/044866, dated Jan. 2, 2013, pp. 1-9.
International Search Report and Written Opinion, PCT/US2012/046231, Date of Mailing Jan. 29, 2013, Korean Intellectual Property Office, Written Opinion 6 pages, International Search Report 3 pages.
Adam J. Maisano, "Cryomilling of Aluminum-Based and Magnesium-Based Metal Powders", Thesis, Virginia Tech, Jan. 13, 2006.
Nie, Xiaowu. "Patents of Methods to Prepare Intermetallic Matrix Composites: A Review," Recent Patents on Materials Science 2008, vol. 1, pp. 232-240.
International Search Report and Written Opinion, International Application No. PCT/US2012/049434, Date of Mailing Feb. 1, 2013, Korean Intellectual Property Office, Written Opinion 4 pages, International Search Report 3 pages.
E.J. Lavenia, B.Q. Han, J.M. Schoenung: "Cryomilled nanostructured materials: Processing and properties", Materials Science and Engineering A, 493, (2008) 207-214.
International Search Report and Written Opinion; International Application No. PCT/US2012/038622; International Filing Date: May 18, 2012; Date of Mailing Dec. 6, 2012; 12 pages.
International Search Report and Written Opinion; International Application No. PCT/US2010/057763; International Filing date Nov. 23, 2010; Korean Intellectual Property Office; International Search Report 7 pages; Written Opinion 3 pages.
International Search Report and Written Opinion; PCT/US2010/059257; Korean Intellectual Property Office; dated Jul. 27, 2011.
Notification of Transmittal of The International Search Report and the Written Opinion of the International Searching Authority; PCT/US2010/059259; International Searching Authority KIPO; Mailed Jun. 13, 2011.
International Search Report and Written Opinion, PCT/US2010/059263, dated Jul. 8, 2011.
Notification of Transmittal of The International Search Report and the Written Opinion of the International Searching Authority; PCT/US2010/059265; International Searching Authority KIPO; Mailed Jun. 16, 2011.
Notification of Transmittal of The International Search Report and the Written Opinion of the International Searching Authority; PCT/US2010/059268; International Searching Authority KIPO; Mailed Jun. 17, 2011.
Notification of Transmittal of the International Search Report and the Written Opinion of the International Searching Authority, or the Declaration mailed on Feb. 23, 2012 (Dated Feb. 22, 2012) for PCT/US2011/043036.
Notification of Transmittal of the International Search Report and the Written Opinion of the International Searching Authority; PCT/US2011/047000; Korean Intellectual Property Office; Mailed Dec. 26, 2011; 8 pages.
International Search Report and Written Opinion of the International Searching Authority for International Application No. PCT/US2011/058099 (filed on Oct. 27, 2011), mailed on May 11, 2012.
International Search Report and Written Opinion of the International Searching Authority, or the Declaration for PCT/US2011/058105 mailed from the Korean Intellectual Property Office on May 1, 2012.
International Search Report and Written Opinion for International application No. PCT/US2012/034973 filed on Apr. 25, 2012, mailed on Nov. 29, 2012.
Patent Cooperation Treaty International Search Report and Written Opinion for International Patent Application No. PCT/US2012/034978 filed on Apr. 25, 2012, mailed on Nov. 12, 2012.
Shumbera et al. "Improved Water Injector Performance in a Gulf of Mexico Deepwater Development Using an Openhole Frac Pack Completion and Downhole Filter System: Case History." SPE Annual Technical Conference and Exhibition, Oct. 5-8, 2003, Denver, Colorado. [Abstract Only].
Vickery, Harold and Christian Bayne, "New One-Trip Multi-Zone Frac Pack System with Positive Positioning." European Petroleum Conference, Oct. 29-31, 2002, Aberdeen, UK. [Abstract Only].
H. Watanabe, T. Mukai, M. Mabuchi and K. Higashi, "Superplastic Deformation Mechanism in Powder Metallurgy Magnesium Alloys and Composites", Acta mater. 49 (2001) pp. 2027-2037.
Xiaowu Nie, Patents of Methods to Prepare Intermetallic Matrix Composites: A Review, Recent Patents on Materials Science 2008, 1, 232-240, Department of Scientific Research, Hunan Railway College of Science and Technology, Zhuzhou, P.R. China.
Baker Oil Tools. "Z-Seal Metal-to-Metal Expandable Sealing Device Uses Expanding Metal in Place of Elastomers," Nov. 6, 2006.
"Reactivity series", Wikipedia, http://en.wikipedia.org/w/index.php?title=Reactivity_series&printable=yes downloaded on May 18, 2014. 8 pages.
Adams, et al.; "Thermal stabilities of aromatic acids as geothermal tracers", Geotherrnics, vol. 21, No. 3, 1992, pp. 323-339.

(56) References Cited

OTHER PUBLICATIONS

Canadian Office Action for Canadian Application No. 2,783,241, dated Feb. 25, 2013, pp. 1-3.
Canadian Office Action for Canadian Application No. 2,783,346, dated Feb. 21, 2013, pp. 1-4.
Canadian Office Action for Canadian Application No. 2,783,547, dated Feb. 15, 2013, pp. 1-3.
Canadian Office Action for Canadian Application No. 2,833,958, dated Sep. 23, 2014, pp. 1-2.
Canadian Office Action for Canadian Application No. 2,833,981, dated Sep. 23, 2014, pp. 1-2.
Carrejo, et al., "Improving Flow Assurance in Multi-Zone Fracturing Treatments in Hydrocarbon Reservoirs with High Strength Corrodible Tripping Balls"; Society of Petroleum Engineers; SPE Paper No. 151613; Apr. 16, 2012; 6 pages.
Chinese Office Action for Chinese Application No. 201080055613.5, dated Nov. 4, 2014, pp. 1-20.
Chinese Office Action for Chinese Application No. 201180012447.5, dated Jul. 3, 2014, 7 pages.
Chinese Office Action for Chinese Application No. 201180052095.6, dated Jul. 21, 2014, pp. 1-32.
Feng, et al., "Electroless Plating of Carbon Nanotubes with Silver" Journal of Materials Science, 39, (2004) pp. 3241-3243.
Flahaut, et al., "Carbon Nanotube-Metal-Oxide Nanocomposites: Microstructure, Electrical Conductivity and Mechanical Properties" Acta amter 48 (2000), pp. 3803-3812.
Garfield, New One-Trip Sand-Control Completion System that Eliminates Formation Damage Resulting From conventional Perforating and Gravel-Packing Operations:, SPE Annual Technical Conference and Exhibition, Oct., Sep. 12, 2005.
Garfield, et al., "Maximizing Inflow Performance in Soft Sand Completions Using New One-trip Sand Control Liner Completion Technology", SPE European Formation Damage Conference, May 25-27, 2005.
Goh, et al., "Development of novel carbon nanotube reinforced magnesium nanocomposites using the powder metallurgy technique", Nanottechnology 17 (2006) 7-12.
International Search Report and Written Opinion; International Application No. PCT/US2012/053339; International Filing Date: Aug. 31, 2012; Date of Mailing: Feb. 15, 2013; 11 pages.
International Search Report and Written Opinion; International Application No. PCT/US2012/053342; International Filing Date: Aug. 31, 2012; Date of Mailing: Feb. 19, 2013; 9 pages.
International Search Report and Written Opinion; International Application No. PCT/US2012/053350; International Filing Date: Aug. 31, 2012; Date of Mailing: Feb. 25, 2013; 10 pages.
International Search Report and Written Opinion; International Application No. PCT/US2014/049347; International Filing Date: Aug. 1, 2014; Date of Mailing: Nov. 24, 2014; 11 pages.
International Search Report and Written Opinion; International Application No. PCT/US2014/054720; International Filing Date: Sep. 9, 2014; Date of Mailing: Dec. 17, 2014; 10 pages.
Li, et al.; "Investigation of aluminium-based nancompsoites with ultra-high strength", Materials Science and Engineering A, 527, pp. 305-316, (2009).
Mathis, "Sand Management: A Review of Approaches and Concerns", Society of Petroleum Engineers, SPE Paper No. 82240, SPE European Formation Damage Conference, The Hague, The Netherlands, May 13-14, 2003.
Rose, et al.; "The application of the polyaromatic sulfonates as tracers in geothermal reservoirs", Geothermics 30 (2001) pp. 617-640.
Seyni, et al., "On the interest of using degradable fillers in co-ground composite materials", Powder Technology 190, (2009) pp. 176-184.
Shaw, "Benefits and Application of a Surface-Controlled Sliding Sleeve for Fracturing Operations"; Society of Petroleum Engineers, SPE Paper No. 147546; Oct. 30, 2011; 8 pages.
Shigematsu, et al., "Surface Treatment of AZ91D Magnesium Alloy by Aluminum diffusion Coating", Journal of Materials Science Letters 19, 2000, pp. 473-475.
Shimizu, et al., "Multi-walled carbon nanotube-reinforced magnesium alloy composites", Scripta Materialia, vol. 58, Issue 4, pp. 267-270.
Singh, et al., "Extended Homogeneity Range of Intermetallic Phases in Mechanically Alloyed Mg-Al Alloys", Elsevier Sciences Ltd., Intemetallics 11, 2003, pp. 373-376.
Stanley, et al.; "An Introduction to Ground-Water Tracers", Department of Hydrology and Water Resources, University of Arizona, Mar. 1985, pp. 1-219.
Sun, et al.; "Colloidal Processing of Carbon Nanotube/Alumina Composites" Chem. Mater. 2002, 14, pp. 5169-5172.
Walters, et al.; "A Study of Jets from Unsintered-Powder Metal Lined Nonprecision Small-Caliber Shaped Charges", Army Research Laboratory, Aberdeen Proving Ground, MD 21005-5066; Feb. 2001.
Xu, et al., "Nanostructured Material-Based Completion Tools Enhance Well Productivity"; International Petroleum Technology Conference; Conference Paper IPTC 16538; International Petroleum Technology Conference 2013; 4 pages.
Zemel, "Tracers in the Oil Field", University of Texas at Austin, Center for Petroleum and Geosystems, Jan. 1995, Chapters 1, 2, 3, 7.
Zhang, et al.; "High Strength Nanostructured Materials and Their Oil Field Applications"; Society of Petroleum Engineers; Conference Paper SPE 157092; SPE International Oilfield Nanotechnology Conference, 2012; 6 pages.
International Search Report and Written Opinion; International Application No. PCT/US2012/071742; International Filing Date: Dec. 27, 2012; Date of Mailing: Apr. 22, 2013; 12 pages.
International Search Report and Written Opinion; International Application No. PCT/US20141058997, International Filing Date: Oct. 3, 2014; Date of Mailing: Jan. 12, 2015; 12 pages.
International Search Report; International Applicational Application No. PCT/US2012/044229, International Filing Date: Jun. 26, 2012; Date of Mailing: Jan. 30, 2013; 3 pages.
Murray, "Binary Alloy Phase Diagrams" Int. Met. Rev., 30(5) 1985 vol. 1, pp. 103-187.
Vernon Constien et al., "Development of Reactive Coatings to Protect Sand-Control Screens", SPE 112494, Copyright 2008, Society of Petroleum Engineers, Presented at the 2008 SPE International Symposium and Exhibition on Formation Damage Control.
Canadian Office Action for Canadian Application No. 2,834,794, dated Dec. 15, 2014, pp. 1-3.
Danish Search Report and Opinion for Danish Application No. PA 2013 00060, dated Dec. 12, 2014, pp. 1-6.

* cited by examiner

METHOD OF CONTROLLING CORROSION RATE IN DOWNHOLE ARTICLE, AND DOWNHOLE ARTICLE HAVING CONTROLLED CORROSION RATE

BACKGROUND

Certain downhole operations involve placement of elements in a downhole environment, where the element performs its function, and is then removed. For example, elements such as ball/ball seat assemblies and fracture (frac) plugs are downhole elements used to seal off lower zones in a borehole in order to carry out a hydraulic fracturing process (also referred to in the art as "fracking") to break up different zones of reservoir rock. After the fracking operation, the ball/ball seat or plugs are then removed to allow fluid flow to or from the fractured rock.

Balls and/or ball seats, and frac plugs, can be formed of a corrodible material so that they need not be physically removed intact from the downhole environment. In this way, when the operation involving the ball/ball seat or frac plug is completed, the ball, ball seat, and/or frac plug is dissolved away. Otherwise, the downhole article may have to remain in the hole for a longer period than is necessary for the operation.

To facilitate removal, such elements can be formed of a material that reacts with the ambient downhole environment so that they need not be physically removed by, for example, a mechanical operation, but instead corrode or dissolve under downhole conditions. However, while corrosion rates of, for example, an alloy used to prepare such a corrodible article can be controlled by adjusting alloy composition, an alternative way of controlling the corrosion rate of a downhole article is desirable.

SUMMARY

The above and other deficiencies of the prior art are overcome by, in an embodiment, a method of removing a downhole assembly includes contacting, in the presence of an electrolyte, a first article including a first material and acting as an anode, and a second article including a second material having a lower reactivity than the first material and acting as a cathode, the downhole assembly including the first article in electrical contact with the second article, wherein at least a portion of the first article is corroded in the electrolyte.

In another embodiment, a method of producing an electrical potential in a downhole assembly includes contacting, with an electrolyte, a first article, the first article including a first material and acting as an anode, and a second article, the second article including a second material having a lower reactivity than the material of the first article and acting as a cathode, with a conductive element to form a circuit.

In another embodiment, a downhole assembly includes a first article including a first material and acting as an anode, and a second article including a second material having a lower reactivity than the first material and acting as a cathode, the first and second articles being electrically connected by a conductive element to form a circuit, wherein in the presence of an electrolyte, the downhole assembly produces an electrical potential, and at least a portion of the first article is corroded.

BRIEF DESCRIPTION OF THE DRAWINGS

Referring now to the drawings wherein like elements are numbered alike in the several Figures.

DETAILED DESCRIPTION OF THE INVENTION

Figure 1A:
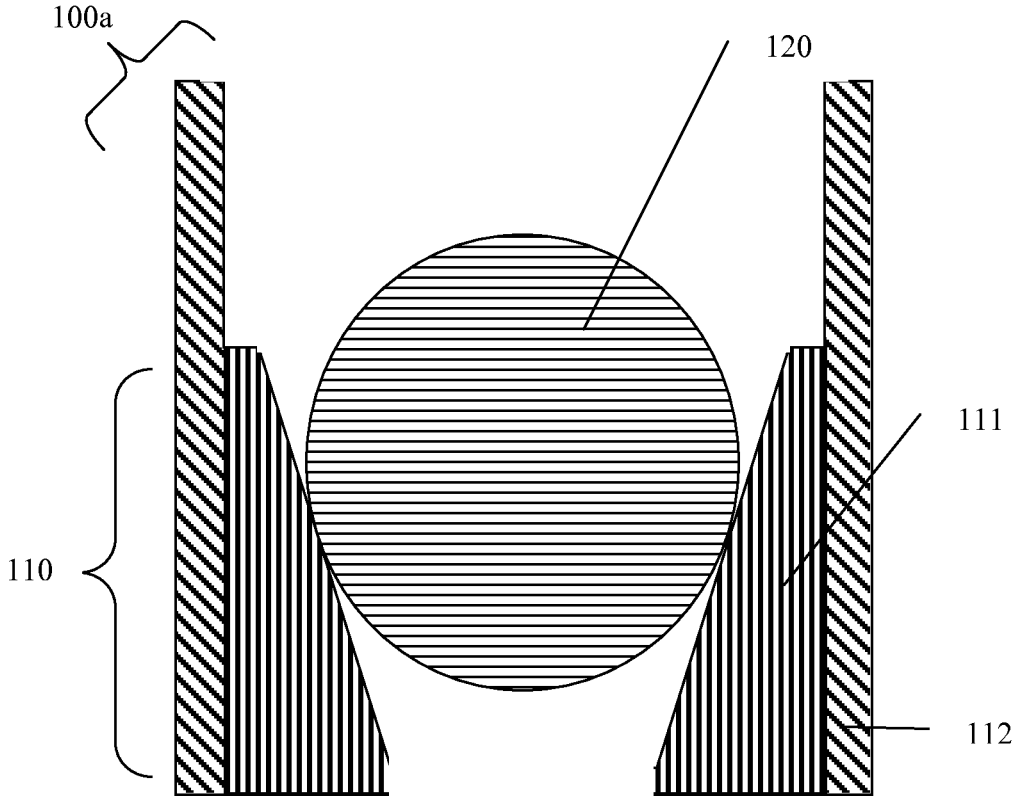
FIG. 1A shows a cross-sectional view of a downhole assembly 100*a* with a ball 120 made of a corrodible first metal, and a seat 110 having a seating portion 111 made of a second metal.

Disclosed herein is a method of controlling the corrosion of a downhole article. The downhole device includes an assembly of two subunits, a first subunit prepared from a first material, and a second subunit prepared from a second material, the first material having a higher galvanic activity (i.e., is more reactive) than the second material. The first and second materials can each be, for example, a different metal from the galvanic series. The first and second materials contact each other in the presence of an electrolyte, such as for example brine. The first subunit is, for example, a ball, made of a corrodible, high reactivity metal such as magnesium, which is anodic, and the second subunit is, for example, a ball seat made of a non-corrodible, relatively low reactivity metal (as compared to the high reactivity metal used to form the ball) such as nickel, iron, cobalt, etc, which is cathodic. Alternatively, in an embodiment, the first subunit is, for example, a ball seat, and the second, a ball. In an embodiment, by selecting the activities of the materials of the two subunits to have a greater or lesser difference in corrosion potentials, the high reactivity material corrodes at a faster or slower rate, respectively.

To initiate galvanic corrosion, electrical coupling of the anodic high reactivity metal and cathodic low reactivity metal is required, and an electrolyte is also present and is at once in contact with both the anode and cathode. In an embodiment, electrically coupling these subunits initiates galvanic corrosion. Where the higher reactivity component (e.g., the ball) is covered with a coating of an oxidation product of the high reactivity metal (such as $Mg(OH)_2$ where the high reactivity metal is magnesium or an alloy thereof), a direct current electrical potential can be applied to (or generated by) the anodic and cathodic subunits via the electrical connection, to initiate the corrosion of the subunit made of high reactivity metal (e.g., the ball). The direct current source can be, for example, a battery placed downhole or at the surface, and electrically connected to the article.

Conversely, when these dissimilar metals are brought into electrical contact in the presence of an electrolyte, an electrochemical potential is generated between the anodic high reactivity metal subunit (i.e., the ball in the above example) and the cathodic low reactivity metal subunit (e.g., a ball seat).

The greater the difference in corrosion potential between the dissimilar metals, the greater the electrical potential generated. In such an arrangement, the cathodic subunit is protected from corrosion by the anodic subunit, where the anodic subunit corrodes as a sacrificial anode. Corrosion of metal subunits in brines and other electrolytes can be reduced by coupling them to more active metals. For example, a steel article electrically coupled to a magnesium article in the presence of brine is less prone to corrosion than a steel article not in electrical contact with a magnesium article.

Electrically coupling the anodic ball and the cathodic ball seat with an electrolyte also produces an electrical potential useful to power a downhole device, such as, for example, a device for downhole signaling or sensing.

A method of removing a downhole assembly thus includes contacting, in the presence of an electrolyte, a first article comprising a first material and acting as an anode, and a second article comprising a second material having a lower reactivity than the material of the first article and acting as a cathode, the downhole assembly including the first article in electrical contact with the second article, wherein at least a portion of the first article is corroded in the electrolyte.

The first material includes any material suitable for use in a downhole environment, provided the first material is corrodible in the downhole environment relative to a second material having a different reactivity. In an embodiment, the first material comprises a magnesium alloy. Magnesium alloys include any such alloy which is corrodible in a corrosive environment including those typically encountered downhole, such as an aqueous environment which includes salt (i.e., brine), or an acidic or corrosive agent such as hydrogen sulfide, hydrochloric acid, or other such corrosive agents. Magnesium alloys suitable for use include alloys of magnesium with aluminum (Al), cadmium (Cd), calcium (Ca), cobalt (Co), copper (Cu), iron (Fe), manganese (Mn), nickel (Ni), silicon (Si), silver (Ag), strontium (Sr), thorium (Th), zinc (Zn), zirconium (Zr), or a combination comprising at least one of these elements. Particularly useful alloys include magnesium alloy particles including those prepared from magnesium alloyed with Ni, W, Co, Cu, Fe, or other metals. Alloying or trace elements can be included in varying amounts to adjust the corrosion rate of the magnesium. For example, four of these elements (cadmium, calcium, silver, and zinc) have to mild-to-moderate accelerating effects on corrosion rates, whereas four others (copper, cobalt, iron, and nickel) have a still greater accelerating effect on corrosion. Exemplary commercially available magnesium alloys which include different combinations of the above alloying elements to achieve different degrees of corrosion resistance include but are not limited to, for example, those alloyed with aluminum, strontium, and manganese such as AJ62, AJ50x, AJ51x, and AJ52x alloys, and those alloyed with aluminum, zinc, and manganese which include AZ91A-E alloys.

It will be appreciated that alloys having corrosion rates greater than those of the above exemplary alloys are contemplated as being useful herein. For example, nickel has been found to be useful in decreasing the corrosion resistance (i.e., increasing the corrosion rate) of magnesium alloys when included in amounts less than or equal to about 0.5 wt %, specifically less than or equal to about 0.4 wt %, and more specifically less than or equal to about 0.3 wt %, to provide a useful corrosion rate for the corrodible downhole article.

The above magnesium alloys are useful for forming the first article, and are formed into the desired shape and size by casting, forging and machining Alternatively, powders of magnesium or the magnesium alloy are useful for forming the first article. The magnesium alloy powder generally has a particle size of from about 50 to about 250 micrometers (μm), and more specifically about 60 to about 140 μm. The powder is further coated using a method such as chemical vapor deposition, anodization or the like, or admixed by physical method such as cryo-milling, ball milling, or the like, with a metal or metal oxide such as Al, Ni, W, Co, Cu, Fe, oxides of one of these metals, or the like. Such coated magnesium powders are referred to herein as controlled electrolytic materials (CEM). The CEM is then molded or compressed into the desired shape by, for example, cold compression using an isostatic press at about 40 to about 80 ksi (about 275 to about 550 MPa), followed by extrusion, forging, or sintering, or machining, to provide a core having the desired shape and dimensions.

It will be understood that the magnesium alloy or CEM, will thus have any corrosion rate necessary to achieve the desired performance of the article. In a specific embodiment, the magnesium alloy or CEM used to form the core has a corrosion rate of about 0.1 to about 150 mg/cm$^2$/hour, specifically about 1 to about 15 mg/cm$^2$/hour using aqueous 3 wt % KCl at 200° F. (93° C.).

The first article optionally has a non-metallic coating on a surface of the first article. The coating includes a soluble glass, a soluble polymer, or a metal oxide or hydroxide coating (including an anodized coating). In an embodiment, the non-metallic coating is an oxidation product of the metal of the first article, particularly where the first article comprises an active metal (relative to the second article). For example, where the first article comprises magnesium alloy, the non-metallic coating can be magnesium hydroxide formed by an anodic process. Alternatively, a hard metal oxide coating such as aluminum oxide can be applied to the surface of the first article by a deposition process.

The non-metallic coating is removed by ambient conditions downhole, or by application of an electric potential. For example, where the coating is a soluble material such as a soluble glass or polymer, the coating dissolves in the ambient downhole fluids, such as water, brine, distillates, or the like, to expose the underlying first material. Alternatively, where a metal oxide or hydroxide is used, an electrical contact can be established between the first and second articles, and an electrical potential applied to perform electrolysis on the coating and induce corrosion.

The second material is, in an embodiment, any metal having a lower reactivity than the first material, based on, for example, the saltwater galvanic series. The second material is also resistant to corrosion by a corrosive material. As used herein, "resistant" means the second material is not etched or corroded by any corrosive downhole conditions encountered (i.e., brine, hydrogen sulfide, etc., at pressures greater than atmospheric pressure, and at temperatures in excess of 50° C.).

By selecting the reactivity of the first and second materials to have a greater or lesser difference in their corrosion potentials, the high reactivity material (e.g., high reactivity metal) corrodes at a faster or slower rate, respectively. Generally, for metals in the galvanic series, the order of metals, from more noble (i.e., less active and more cathodic) to less noble (i.e., more active, and more anodic) includes for example steel, tungsten, chromium, nickel, cobalt, copper, iron, aluminum, zinc, and magnesium. The second material includes steel, tungsten, chromium, nickel, copper, iron, aluminum, zinc, alloys thereof, or a combination comprising at least one of the foregoing, where the first material is magnesium or an alloy thereof. In a specific embodiment, the first material is a magnesium alloy, and the second material is steel, nickel, cobalt, or copper.

In an embodiment, the second article is entirely fabricated of the second material, or the second article includes a layer of the second material. Here, a layer includes a single layer, or multiple layers of the same or different materials. Where layers are used, the underlying material is a metal, ceramic, or the like, and in an embodiment is, for example, fabricated from the first material such that it is separated from the first material of the first article by the layer(s) of second material.

The first article and second article are not limited to any particular shape or function. In an embodiment, the first and second articles are used together in a fitted assembly. For example, in one embodiment, the first article is CEM ball, and the second article is a ball seat. Alternatively, the first article is a CEM ball seat, and the second article is a ball. In another embodiment, the first article is a CEM fracture plug and the second is the housing for the fracture plug. In an embodiment, the first article is a CEM ball or frac plug, and the second article is the ball seat or housing (respectively), where this arrangement allows for greater adaptability of a system in which a variety of non-fixed articles (e.g., a ball) are all be used with one type of fixed article (such as a ball seat). Where desired, a portion of the fixed article (e.g., ball seat) is formed of a CEM coated with a more noble (second) metal such as zinc, aluminum, or nickel, so that the fixed article is removed by removing the second metal coating, and corroding the underlying CEM.

In an embodiment, the first article comprises a non-corrodible core comprising the second material and at least partially penetrating the first article, and a corrodible surrounding structure comprising the first material, wherein only the surrounding structure is corroded. The first article in this way is partially composed of the first material and second material. For example, the first article is a ball or elongated structure having one or more non-corrodible cores inserted part way into the article, or running axially or along a chord through the center of or off-center (respectively) of the ball or structure. Any dimension of the first article can be penetrated; in one embodiment, the longest dimension is traversed by the core. Thus, in an embodiment, the first article includes a low reactivity core (e.g., nickel) partially penetrating the first article, and a corrodible surrounding structure (e.g., a magnesium alloy or CEM).

In a non-limiting example, the first article is a corrodible ball formed of a magnesium alloy or CEM, having one or more nickel cores or screws inserted into it. This arrangement provides for close contact of the first and second materials, where the corrosion of the first article is accelerated by placing the article downhole and electrically connecting one or more of the nickel screws with the magnesium alloy ball. Conversely, the first article is a corrodible seat having one or more non-corrodible cores partially or fully penetrating (e.g., screwed) radially into the side. The presence of these cores provides additional contact between the first and second materials, and facilitates electrical contact with a second article (e.g., a ball where the first article is a seat, or vice versa).

In another embodiment, the first article comprises a corrodible core comprising the first material and at least partially penetrating the first article, and a non-corrodible surrounding structure comprising the second material, wherein only the core is corroded. The first article in this way includes a corrodible core penetrating through a long axis or diameter of the first article, and a non-corrodible surrounding structure. Application of a controlled corrosion to such first articles would then result in only the core being corroded, leaving a channel through the ball. In a non-limiting example, the first article is a non-corrodible ball made of a low reactivity material (e.g., of aluminum or nickel), with one or more high reactivity (e.g., magnesium alloy) cores penetrating (e.g., screwed into or formed) therethrough.

Conversely, the first article is the seat having a corrodible core penetrating (e.g., screwed) radially through the side, where the corrosion and removal of the corrodible core opens to the underlying sidewall and any features (e.g., channels, etc) beneath. In this way, the ball (or seat) is used to allow a partial flow. In further embodiments, the core comprises more than one metal in successive layers, each having a different reactivity. This arrangement can be used to selectively increase the flow, such as by forming the first article of concentric layers of increasingly noble metals (on the galvanic scale, such as layers of different magnesium alloys, which are corrodible relative to the surrounding structure), which would allow a gradual increase in the size of the channel as additional layers are corroded.

The electrolyte includes an aqueous or non-aqueous electrolyte, depending on the application and controllability of ambient conditions. A non-aqueous electrolyte includes an ionic liquid, a molten salt, an ionic liquid dissolved in an oil, or a salt dissolved in a polar aprotic solvent such as ethylene carbonate, propylene carbonate, dimethylformamide, dimethylacetamide, gamma-butyrolactone, or other such solvents. However, where the article is a downhole element, controlling the ambient conditions to exclude moisture is not practical, and hence, under such conditions, the electrolyte is an aqueous electrolyte. Aqueous electrolytes include water or a salt dissolved in water, such as brine, an acid, or a combination comprising at least one of the foregoing.

In a method of controlling corrosion in a downhole environment, corroding the first article by the electrolyte is accomplished by electrically contacting the first and second articles in the presence of the electrolyte, optionally by inducing the corrosion by applying a potential to the first and second articles in the presence of the electrolyte. A direct current electrical potential can thus be applied to the anode and cathode (second and first articles, respectively, where the first and second articles are electrically insulated from one another and the cell is being run in reverse) via the electrical connection, to initiate the corrosion in the first article. The source of the direct current for this process can be, for example, a moving sleeve within the article, in which the sleeve is mechanically coupled to a power source (a battery, magneto, or a small generator which generates a current by induction).

In another embodiment, the downhole assembly, when electrically connected to provide a complete electrical circuit, produces electrical current by forming a galvanic cell in which the first and second articles (i.e., anode and cathode, comprising the first and second metals, respectively, where the cell is being run forward) are electrically connected by a bridging circuit in the presence of the electrolyte. The first and second articles are not in direct electrical contact with each other but are in electrical contact through (i.e., in common electrical contact with) an electrolyte, or where in physical contact are separated by, for example an insulating material such as a coating of $Mg(OH)_2$ or a non-conductive O-ring to prevent a short circuit of the cell. Such an arrangement is sufficient to provide power to run a device such as for example, a transmitter or sensor, or other such device. Thus, a method of producing an electrical potential in a downhole assembly includes contacting, with an electrolyte, a first article, the first article comprising a first metal and acting as an anode; and a second article, the second article comprising a second metal having a lower reactivity than the metal of the first article and acting as a cathode. The anode and cathode are in common electrical contact with each other via a conductive element (e.g., an electric load, such as a sensor or heater) to form a circuit.

A downhole assembly includes a first article comprising a first material, and a second article comprising a second material having a lower reactivity than the material of the first article and acting as a cathode, the first and second articles being electrically connected by a conductive element (e.g., electric load) to form a circuit, wherein in the presence of an electrolyte, the downhole assembly produces an electrical potential, and at least a portion of the first article is corroded.

Different exemplary embodiments of the downhole assembly are further described in the Figures.

FIG. 1A shows a cross-sectional view of a downhole assembly 100*a*. In the assembly 100*a*, a ball 120 made of a corrodible first metal is seated in a seat 110 having a seating portion 111 made of a second metal and contained in a housing 112. The ball 120 and seat 110 are in direct electrical contact with each other when an electrolyte is present, or where no insulating layer (such as $Mg(OH)_2$) or other material separates ball 120 and seat 110.

Figure 1B:
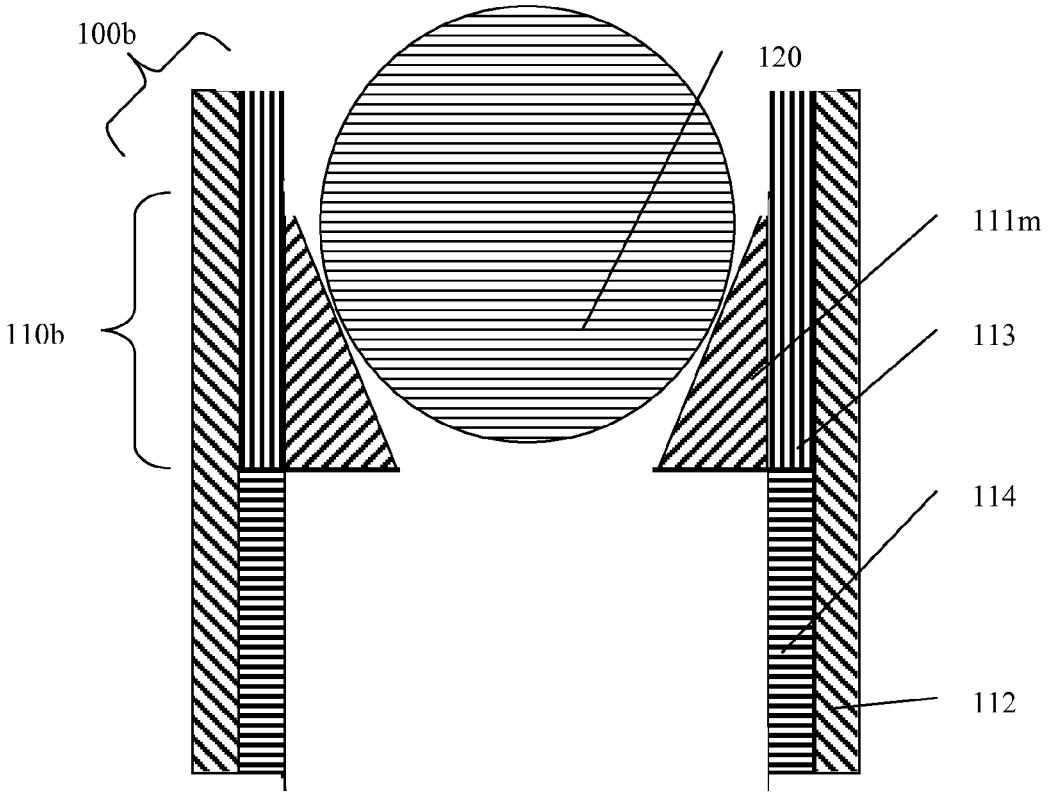
FIGS. 1B and 1C show a cross-sectional view of a downhole assembly (100*b*, 100*c*) with a ball 120 and a seat 111*m* shifting from a first position 110*b* to a second position 110*c* to place the seat 111*m* in contact with an insert 114 made of a second metal to initiate corrosion.
Figure 1C:
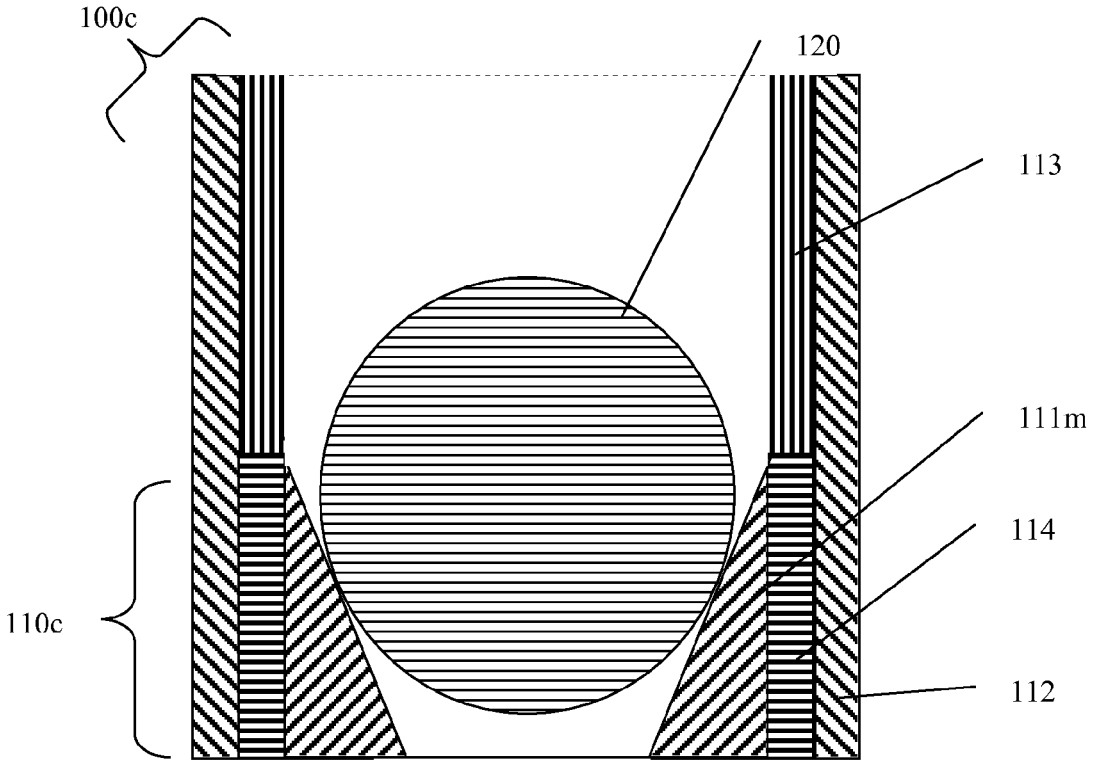

In another embodiment, shown in FIGS. 1B and 1C, the ball 120 is seated in a movable seating portion 111*m* (initial assembly 100*b* in FIG. 1B). The seat 111*m* comprises the first metal, and is a movable unit held initially in a first position 110*b* in contact with the sidewall 113 not comprising a second metal. Upon seating ball 120 in the seat 111*m*, the seat 111*m* is shifted longitudinally through a surrounding housing 112 from the first position (110*b* in FIG. 1B), to a second position (110*c* in FIG. 1C) to provide the shifted assembly 100*c* in FIG. 1C, in which the seat 111*m* is in contact with an insert 114 formed of the second metal. In initial assembly 100*b*, insert 114 is electrically insulated from sidewall 113. In this way, the seat 111*m* is not corroded until it is moved into galvanic contact with the insert 114 of the second material. Also in an embodiment, the ball 120, seat 111*m*, and insert 114 are each formed of different materials of construction, where each is interchangeably made of the first metal, second metal, or a third metal having a reactivity intermediate to the first and second metals.

Figure 2:
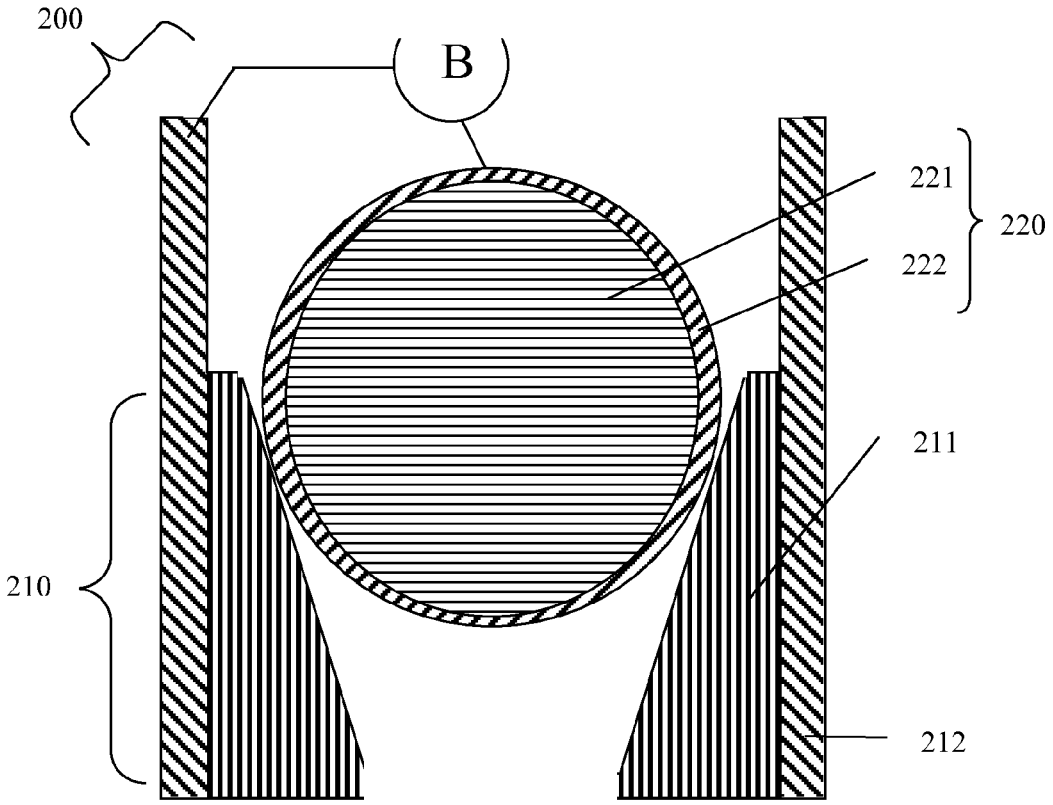
FIG. 2 shows a cross-sectional view of a downhole assembly 200 with a ball 220 with a core 221 made of a corrodible first metal, a coating 222, and a seat 210 having a seating portion 211 made of a second metal, in which a bridging connection B electrically connects the ball 220 and seat 210.

In another embodiment, FIG. 2 shows a cross-sectional view of a downhole assembly 200 with a ball 220 with a core 221 made of a corrodible first metal, a coating 222, and a seat 210 having a seating portion 211 made of a second metal and contained in a housing 212. In an embodiment, the coating is, for example, an oxidation product of the metal of the corrodible first metal (e.g., $Mg(OH)_2$ where the first metal is magnesium or a magnesium alloy). It will be appreciated that, in an embodiment, the presence of the coating electrically insulates the ball 220 from the seat 210, and hence, application of current by a power source electrically connected to a bridging connection (B) and which electrically connects the ball 220 and seat 210, initiates corrosion of ball 220, when an electrolyte is present.

Figure 3A:
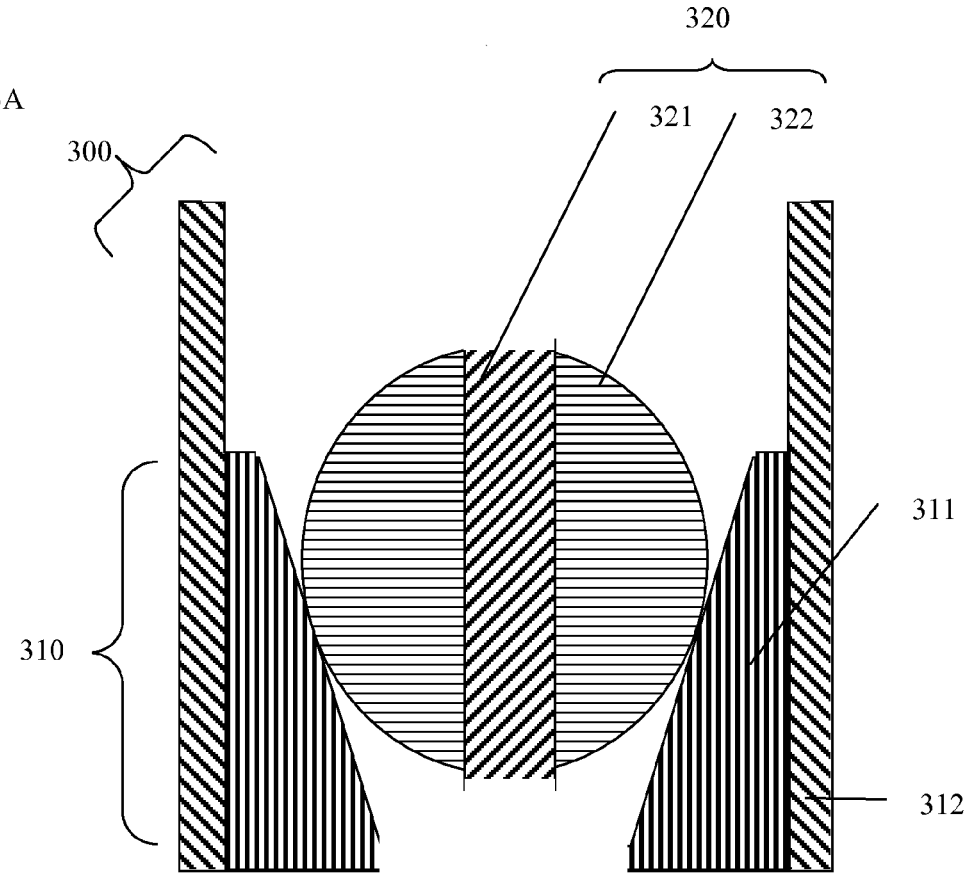
FIG. 3A shows a cross-sectional view of a downhole assembly 300 with a ball 320 with an axial core 321 of a first metal surrounded by an outer core 322, a seat 310 having a seating portion 311 made of a second metal.

In another example, FIG. 3A shows a cross-sectional view of a downhole assembly 300 with a ball 320 with an axial core 321 of a first metal surrounded by an outer core 322, a seat 310 having a seating portion 311 made of a second metal and housing 312. An optional bridging connection B (not shown) electrically connects the ball 320 and seat 310, and initiates corrosion of axial core 321 by application of current, where an insulative coating (not shown) is present, or generates a potential.

In another embodiment, the axial core 321 can be made of the first metal, while the outer core 322 can be made of the second metal, where the axial core 321 corrodes leaving the outer core 322. Similarly, in another embodiment, the axial core 321 can be made of the second metal, while the outer core 322 can be made of the first metal, where the outer core 322 corrodes leaving the axial core 321. In these embodiments, axial core 321 and outer core 322 remain in constant electrical contact. Because any $Mg(OH)_2$ coating on the first metal is incomplete, electrolyte contacts both the axial and outer cores 321 and 322, respectively. In the embodiment, the part of the article made of the more reactive first metal will corrode faster, and the material of the seating portion 311 therefore does not govern the galvanic interaction.

It is noted that axial core 321 and outer core 322 remain in constant electrical contact. Because any $Mg(OH)_2$ coating on the first metal is incomplete, electrolyte contacts both the axial core 321 and the outer core 322. In this embodiment, the part of the article (e.g., the ball) made of the more active first metal will corrode faster, and the material of the seating portion 311 therefore does not affect the corrosion of the axial or outer cores 321 or 322.

Figure 3B:
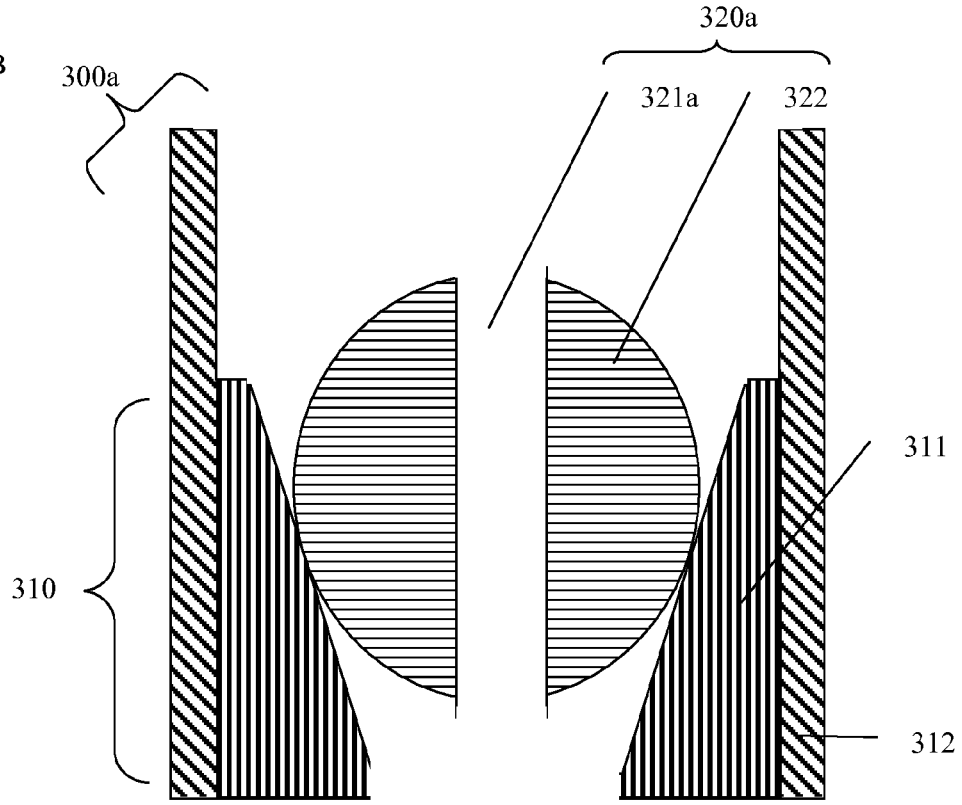
FIG. 3B shows a cross-sectional view of a downhole assembly 300*a* after removal of axial core 321 in FIG. 3A, with a ball 320*a* with an channel 321*a* surrounded by an outer core 322, and a seat 310 having a seating portion 311 made of a second metal.

FIG. 3B shows a cross-sectional view of a downhole assembly 300*a* similar to that of FIG. 3A but after corrosion of the first metal (where the axial core 321*a* comprises the first metal), with a ball 320*a* having a channel 321*a* (corresponding to the axial core 321 in FIG. 3A, now removed) surrounded by an outer core 322, and a seat 310 having a seating portion 311 made of a second metal and contained in a housing 312. The channel 321*a* allows only a limited opening between zones above and below the seated ball, to restrict the flow of fluid between these to an intermediate level.

In another embodiment, a frack plug of the first metal and having a ball or check valve of the first metal has a cap of an additional active material, such as a reactive magnesium alloy powder that is more reactive than the first metal, placed on top of the plug. In this way, the corrosion of the additional active material by contact with the less reactive frack plug/ball/check valve allows access to the ball or check valve.

While one or more embodiments have been shown and described, modifications and substitutions may be made thereto without departing from the spirit and scope of the invention. Accordingly, it is to be understood that the present invention has been described by way of illustrations and not limitation.

All ranges disclosed herein are inclusive of the endpoints, and the endpoints are independently combinable with each other. The suffix "(s)" as used herein is intended to include both the singular and the plural of the term that it modifies, thereby including at least one of that term (e.g., the colorant(s) includes at least one colorants). "Optional" or "optionally" means that the subsequently described event or circumstance can or cannot occur, and that the description includes instances where the event occurs and instances where it does not. As used herein, "combination" is inclusive of blends, mixtures, alloys, reaction products, and the like. All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The invention claimed is:

1. A method of removing a downhole assembly, comprising contacting, in the presence of an electrolyte, a first article comprising a first material and acting as an anode, and a second article comprising a second material having a lower reactivity than the first material and acting as a cathode, the downhole assembly comprising the first article in electrical contact with the second article, wherein at least a portion of the first article is corroded in the electrolyte; and wherein the first material comprises a magnesium alloy having less than or equal to about 0.5 weight percent of nickel.

2. The method of claim 1, wherein the first article has a non-metallic coating on a surface thereof.

3. The method of claim 2, wherein the coating comprises a soluble glass, a soluble polymer, or a metal oxide or hydroxide coating.

4. The method of claim 2, wherein the non-metallic coating is magnesium hydroxide.

5. The method of claim 2, wherein the non-metallic coating is removed by application of an electric potential to establish electrical contact between the first and second articles.

6. The method of claim 1, wherein the second material comprises steel, tungsten, chromium, nickel, cobalt, copper, iron, aluminum, zinc, alloys thereof, or a combination comprising at least one of the foregoing.

7. The method of claim 1, wherein the first article is a controlled electrolytic material (CEM) ball or fracture plug.

8. The method of claim 1, wherein the second article is a ball seat.

9. The method of claim 1, wherein the first article comprises:

a corrodible core comprising the first material and at least partially penetrating the first article, and a non-corrodible surrounding structure comprising the second material, wherein only the core is corroded.

10. The method of claim 1, wherein the first article comprises:

a non-corrodible core comprising the second material and at least partially penetrating the first article, and a corrodible surrounding structure comprising the first material, wherein only the surrounding structure is corroded.

11. The method of claim 1, wherein the electrolyte is water, brine, acid, or a combination comprising at least one of the foregoing.

12. The method of claim 1, wherein the first material and the second material are selected such that the first material has a corrosion rate of about 0.1 to about 150 $mg/cm^2$/hour using aqueous 3 wt % KCl at 200° F.

13. The method of claim 1, wherein the magnesium alloy in the first material further comprises one or more of the following: Al; Cd; Ca; Co; Cu; Fe; Mn; Si; Ag; Sr; Th; Zn; or Zr.

14. A method of producing an electrical potential in a downhole assembly, comprising contacting, with an electrolyte, a first article, the first article comprising a first material and acting as an anode, and a second article, the second article comprising a second material having a lower reactivity than the material of the first article and acting as a cathode, with a conductive element to form a circuit;

wherein the first material comprises a magnesium alloy having less than or equal to about 0.5 weight percent of nickel.

15. The method of claim 14, wherein the electrolyte is water, brine, an acid, or a combination comprising at least one of the foregoing.

16. The method of claim 14, wherein the second material comprises steel, tungsten, chromium, nickel, cobalt, copper, iron, aluminum, zinc, alloys thereof, or a combination comprising at least one of the foregoing.

17. The method of claim 14, further comprising corroding the first article in the electrolyte.

18. A downhole assembly, comprising:

a first article comprising a first material and acting as an anode, and a second article comprising a second material having a lower reactivity than the first material and acting as a cathode, the first and second articles being electrically connected by a conductive element to form a circuit, wherein in the presence of an electrolyte, the downhole assembly produces an electrical potential, and at least a portion of the first article is corroded; and wherein the first material comprises a magnesium alloy having less than or equal to about 0.5 weight percent of nickel.

19. The article of claim 18, wherein the second material comprises steel, tungsten, chromium, nickel, cobalt copper, iron, aluminum, zinc, alloys thereof, or a combination comprising at least one of the foregoing.

20. The article of claim 18, wherein the first article is a ball, and the second article is a ball seat.

21. A method of removing a downhole assembly, comprising:

contacting, in the presence of an electrolyte, a first article comprising a first material and acting as an anode, and a second article comprising a second material having a lower reactivity than the first material and acting as a cathode, the downhole assembly comprising the first article in electrical contact with the second article, wherein at least a portion of the first article is corroded in the electrolyte; and wherein the first article has a non-metallic coating comprising magnesium hydroxide on a surface thereof.

* * * * *